United States Patent [19]

Hotta et al.

[11] 4,301,227

[45] Nov. 17, 1981

[54] ELECTROPHOTOGRAPHIC LIQUID DEVELOPER

[75] Inventors: Seiji Hotta, Hirakata; Hitoshi Kawahara, Tokyo; Minoru Hatori, Takarazuka; Fumio Koseki, Ibaraki, all of Japan

[73] Assignee: Sumitomo Chemical Company, Limited, Osaka, Japan

[21] Appl. No.: 699,373

[22] Filed: Jun. 24, 1976

Related U.S. Application Data

[63] Continuation of Ser. No. 415,929, Nov. 15, 1973, abandoned.

[30] Foreign Application Priority Data

Mar. 29, 1973 [JP] Japan ..... 48-36472

[51] Int. Cl.[3] ..... G03G 9/12; G03G 9/10

[52] U.S. Cl. ..... 430/106; 430/108; 430/112; 430/114; 430/117

[58] Field of Search ..... 252/62.1; 96/1 LY, 1 PE, 96/1.6; 427/15; 430/106, 108, 112, 114, 117

[56] References Cited

U.S. PATENT DOCUMENTS

| | | | |
|---|---|---|---|
| Re. 27,912 | 2/1974 | Miller | 252/62.1 L |
| 3,383,993 | 5/1968 | Yeh | 96/1 PE |
| 3,384,566 | 5/1968 | Clark | 96/1 PE |
| 3,391,015 | 7/1968 | Fauser | 252/62.1 L |
| 3,669,886 | 6/1972 | Kosel | 252/62.1 L |
| 3,681,064 | 8/1972 | Yel | 96/1 PE |
| 3,720,619 | 5/1973 | Inoue et al. | 252/62.1 L |
| 3,772,053 | 11/1973 | Eastman et al. | 96/1 LY |
| 3,821,113 | 6/1974 | Morikawa et al. | 252/62.1 L |
| 3,849,165 | 11/1974 | Stahly et al. | 117/37 LE |

OTHER PUBLICATIONS

Color Index, 3rd. Ed., vol. 3, 1971, pp. 4382, 4390, 4394, 4417–4423 and 4437–4440.

Research Disclosures, Product Licensing Index, 8/72, pp. 54–56.

*Primary Examiner*—Charles L. Bowers, Jr.

*Attorney, Agent, or Firm*—Birch, Stewart, Kolasch & Birch

[57] ABSTRACT

An electrophotographic developer containing a carrier, a resinous, waxy or varnish compound and as a color component, a phosphotungstomolybdic acid lake of a mixture of an indolenine dye of the formula (I):

(I)

wherein A is a benzene or naphthalene nucleus, $R_1$ is a $C_1$–$C_4$ alkyl group $R_2$ and $R_3$ are respectively a hydrogen atom or a $C_1$–$C_4$ alkyl group, $R_4$ and $R_5$ are respectively a hydrogen atom, a $C_1$–$C_4$ alkyl, β-hydroxyethyl, β-chloroethyl, β-cyanoethyl, aralkyl, cycloalkyl, phenyl, or substituted phenyl. Y is a hydrogen or halogen atom, or a nitro, alkyl, alkoxy, carbalkoxy or acetamido group, and $X^-$ is a colorless anion, with a xanthene dye of the formula (II):

(II)

wherein $R_6$, $R_7$, $R_{10}$, $R_{11}$ and $R_{12}$ are respectively a hydrogen atom or a $C_1$–$C_4$ alkyl group, $R_8$ and $R_9$ are respectively a $C_1$–$C_4$ alkyl group, and $Y^-$ is a colorless anion.

6 Claims, No Drawings

ELECTROPHOTOGRAPHIC LIQUID DEVELOPER

This application is a continuation of copending application Ser. No. 415,929, filed on Nov. 15, 1973, abandoned.

The present invention relates to an electrophotograhic red developer.

As is well known, various types of electrophotography have been developed, and the basic processes which are common to them comprise applying corona discharge to a photoconductive layer bonded to a suitable support thereby producing an over-all uniform distribution of electrical charges on the layer, exposing the layer to a light pattern thereby forming an electrostatic latent image, producing a visible image of the electrical charge pattern with a developer, and then, if necessary, applying a suitable fixing treatment to the visible image.

The present invention relates to developers, particularly to new liquid type red developers suitable for use in such processes.

As far as conventional red developers are concerned, there is disclosed, for example in Japanese Patent Publication No. 10197/1964, the use of aroic pigments such as para red, toluidine red, lithol red and the like, and phosphotungstomolybdic acid lake pigments of rhodamine type dyes such as Brillfast Rose Red (C.I. Pigment Red 81) and Brillfast Geranium (C.I. Pigment Red 82). These pigments are not always satisfactory because they often cause flowing of a developed image from a solid area (an uniformly printed area), and they have an inherently low color value.

Furthermore, these pigments usually have an electrical property which varies greatly with different lots in manufacture, and their toners are considerably susceptible to a change with the lapse of time during storage, and cause a pigment settlement due to aggregation of the pigment or a color depth reduction of the image, thereby making difficult the constant formation of a stable developed image.

Thus, an object of the present invention is to provide a novel developer free from the disadvantages as mentioned above.

The object of the invention can be accomplished by providing a novel electrophotographic developer containing a carrier, a resinous, waxy or varnish compound and as a color component, a phosphotungatomolybdic acid lake of a mixture of an indolenine dye of the formula (I):

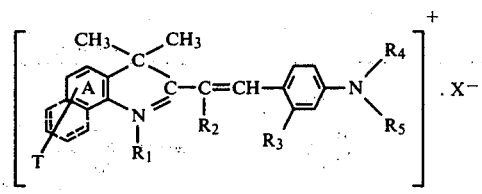

(I)

wherein A is a benzene or naphthalene nucleus, $R_1$ is a $C_1$–$C_4$ alkyl group, $R_2$ and $R_3$ are respectively a hydrogen atom or a $C_1$–$C_4$ alkyl group, $R_4$ and $R_5$ are respectively a hydrogen atom, a $c_1$–$c_4$ alkyl, β-hydroxyethyl, β-chloroethyl, β-cyanoethyl, aralkyl, cycloalkyl, phenyl, or substituted phenyl, Y is a hydrogen or halogen atom, or a nitro, alkyl, alkoxy, carbalkoxy or acetamido group, and $X^-$ is a colorless anion, with a xanthene dye of the formula (II):

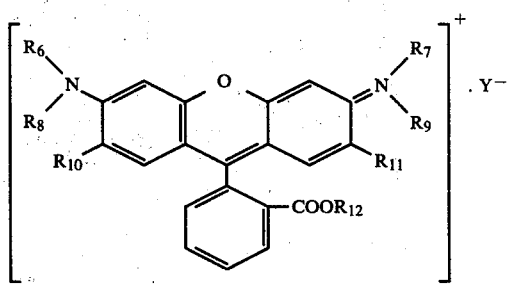

(II)

wherein $R_6$, $R_7$, $R_{10}$, $R_{11}$ and $R_{12}$ are respectively a hydrogen atom or a $C_1$–$C_4$ alkyl group, $R_8$ and $R_9$ are respectively a $C_1$–$C_4$ alkyl group, and $Y^-$ is a colorless anion.

The mixing ratio by weight of the dye of the formula (I) to the dye of the formula (II) may be variable within a range of from 1:99 to 99:1.

The preferred examples of an indolenine dye of the formula (I) which can be used in the present invention are shown hereinafter together with the chemical structures thereof and the shades of the phosphotungstomolybdic acid lakes thereof.

| No. | Dye structures | Shades of phosphotungstomolybdic acid lakes |
|---|---|---|
| 1 | 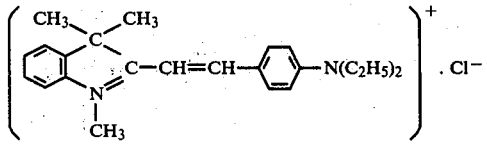 | Red |
| 2 | 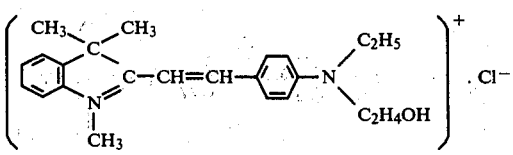 | Red |

-continued
| No. | Dye structures | Shades of phospho-tungsto-molybdic acid lakes |
|---|---|---|
| 3 | 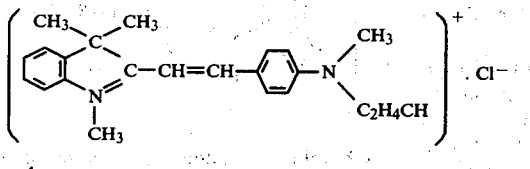 | Red |
| 4 | 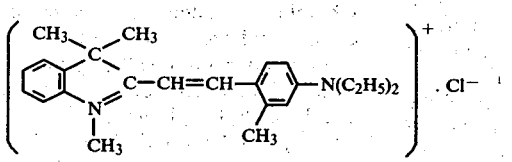 | Red |
| 5 | 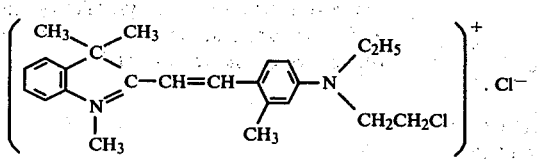 | Red |
| 6 | 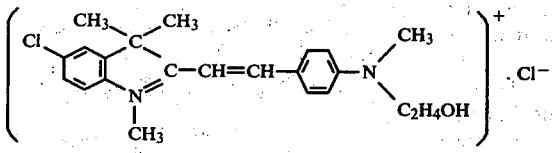 | Red |
| 7 | 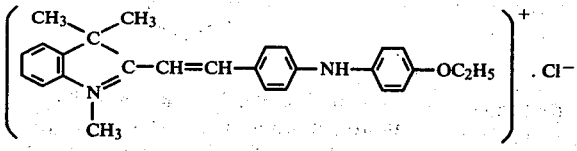 | Violet |
| 8 | 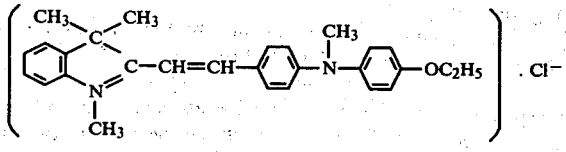 | Violet |
| 9 | 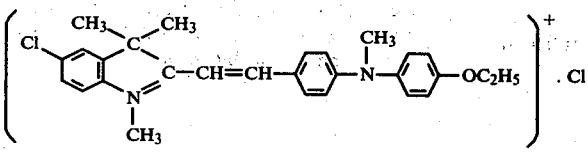 | Violet |
| 10 | 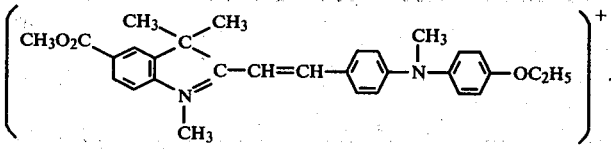 | Violet |
| 11 | 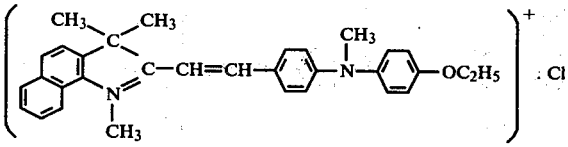 | Violet |
| 12 | 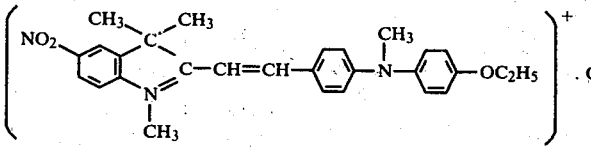 | Reddish blue |

-continued

| No. | Dye structures | Shades of phospho-tungsto-molybdic acid lakes |
|---|---|---|
| 13 | 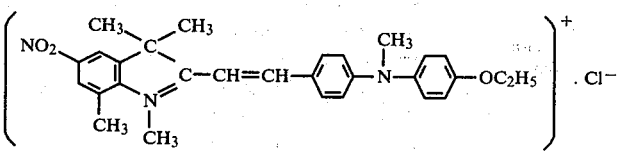 | Reddish blue |
| 14 | 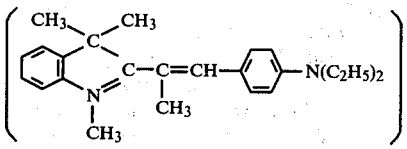 | Red |
| 15 | 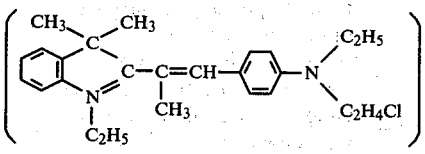 | Red |
| 16 | 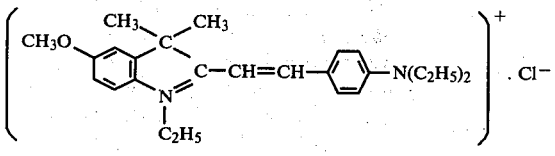 | Yellowish red |
| 17 | 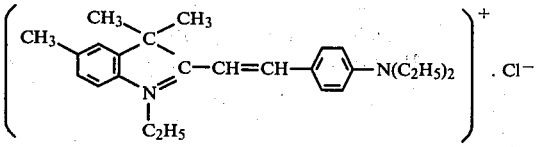 | Red |
| 18 | 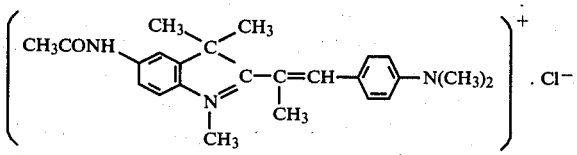 | Yellowish red |
| 19 | 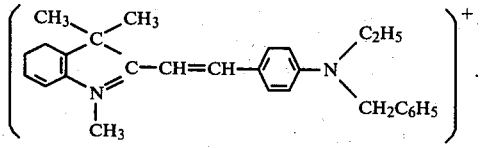 | Red |
| 20 | 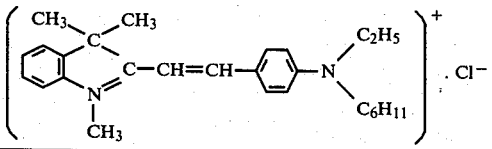 | Red |
| 21 | 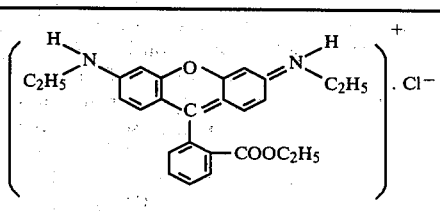 | Bluish red |

The preferred examples of the xanthene dye of the formula (II) which can be used in the present invention are shown hereinafter together with the chemical structures thereof and the shades of the phosphotungstomolybdic acid lakes thereof.

-continued

22 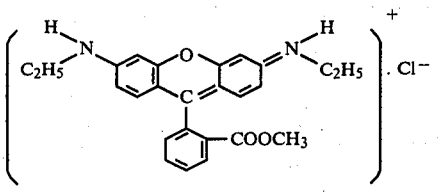 Bluish red

23 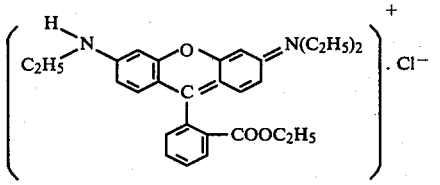 Bluish red

24 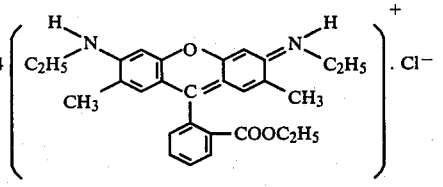 Bluish red

25 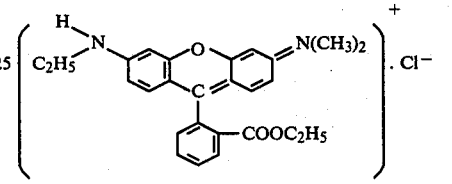 Bluish red

26 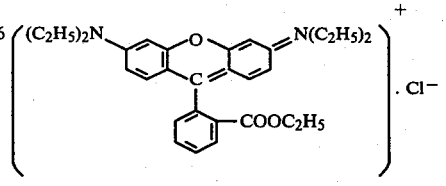 Reddish violet

27 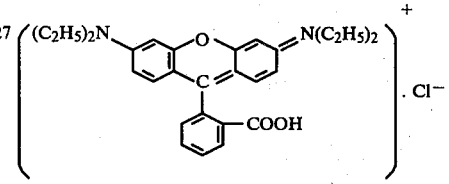 Reddish violet

28 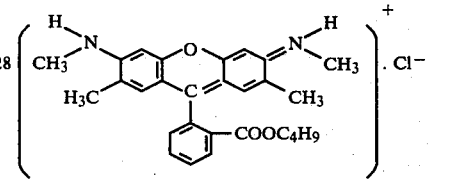 Bluish red

The anions, $X^-$ and $Z^-$, in the formulae (I), (II) and (III) are usually a chlorine ion but may be any other colorless anion such as $Br^-$, $H_2PO_4^-$ or $ZnCl_3^-$ ion.

The mixture of the two different type dyes represented by the formulae (I) and (II), respectively, can be converted into its phosphotungstomolybdic acid lake by conventional methods well known to those skilled in the art. For example, and the lake can be obtained by mixing an aqueous acetic acid solution of the mixture and an aqueous solution of phosphotungstomolybdic acid to form the lake as precipitates, which are then filtered and washed.

For obtaining a mixed lake pigment of the two dyes represented by the formulae (I) and (II), respectively, the two lake pigments separately prepared may be mixed together. However, it is more desirable for a mixed lake pigment of uniform and stable quality to co-precipitate the two lakes.

The mixing proportion of the two dyes can be decided properly according to the required shade.

A mixed lake pigment of a required characteristic can be obtained by mixing at least 1% by weight of the dye of the formula (I) with the dye of the formula (II) and selecting the kinds of the two dyes and their mixing proportion most appropriately.

The present invention relates to a developer obtained by a method comprising dispersing the lake pigments thus prepared in a carrier such as a high electrical resistivity liquid, preferably having above $10^{10}\Omega$cm of volume resistivity, and adding an additive agent such as a control agent or a surfactant if necessary, and a resinous, waxy or varnish substance.

The dispersion process of the lake pigments, which may be dry or wet, may be carried out using a conventional dispersing apparatus such as a ball mill, a roller mill or an attritor in the same conventional manner as in the preparation of paint and ink.

Examples of the high electrical resistivity liquids, namely carrier liquids, include aliphatic, alicyclic and halogen-substituted hydrocarbons, such as normal paraffin, isoparaffin, ligroin, kerosene, cyclohexane, chlorinated hydrocarbons and chlorinated and fluorinated hydrocarbons; more concretely, Shellsol 71 (isoparaffin, a registered trademark of Shell Petroleum Co., Ltd.), Isopar H and Isopar G (isoparaffin, a registered trademark of Esso Co., Ltd.) and trichlorotrifluoroethane.

The additive agents such as a control agent to modify the charge, a surfactant and the like may be polyvalent metal salts of organic acids including naphthenic acid, stearic acid and oleic acid; for example, calcium naphthenate, cobalt naphthenate, manganese naphthenate, aluminum naphthenate, zinc naphthenate, zirconium naphthenate, copper naphthenate, iron naphthenate, cobalt oleate and aluminum stearate.

The resinous, waxy or varnish substances include oil-modified alkyd resins, rosin-modified phenolformaldehyde resins, polyhydric alcohol esters of hydrogenated rosins, polyaryl or polymethacryl ester resins, polyvinyl acetate and polystyrene. The substances which are used in the present invention are particularly preferably a uniform mixture of vegetable oils and alkyl phenolic resins belonging to an oil-soluble phenolic resin, or a varnish which is a pre-condensate or polycondensate of said resins and oils. The alkyl phenolic resins may be either a novolak type or a resol type. The vegetable oils include linseed oil, tung oil, soy-bean oil and rape-seed oil. The varnishes are prepared by conventional methods.

The developers of the present invention hold positive charges in a stable state, and impart an attractive development and repulsive development when applied to a negatively charged and positively charged electrostatic latent image, respectively. In either development, the present developers can produce a visible image of excellent tone reproduction and high color value.

The present invention will be illustrated with reference to the following examples, which are only given for the purpose of illustration and are not to be interpreted as limiting. Unless otherwise mentioned, all parts in the examples are by weight.

REFERENCE EXAMPLE 1 (Preparation of a red lake pigment)

(1) Preparation of a dye solution

| | |
|---|---|
| Rhodamine 6G extra (No. 24 dye mentioned hereinbefore, C.I. Basic Red 1) | 2.32 parts |
| An indolenine dye of the formula: | |

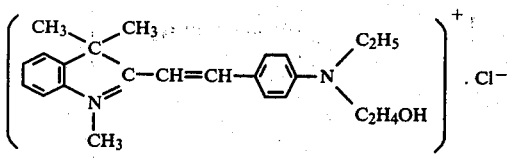

| | |
|---|---|
| | 0.58 part |
| Glacial acetic acid | 0.2 part |
| Water | 200 parts |

The two dyes were added to a mixed solution of water and acetic acid and dissolved at 55° C.

(2) Preparation of a mordant

| | |
|---|---|
| Sodium tungstate | 5.16 parts |
| Sodium molybdate | 2.67 parts |
| Disodium hydrogen phosphate | 0 87 part |
| Water | 29 parts |
| Hydrochloric acid | 4.6 parts |

The three sodium salts were dissolved in water at 90° C., and then hydrochloric acid was added thereto. The resulting solution was stirred at 90° C. and then allowed to cool to 50° to 55° C.

(3) Lake-formation

The phosphotungstomolybdic acid solution thus prepared was added to the above dye solution. The resulting solution was stirred at 50° to 55° C., heated to 80° C. and maintained at the same temperature for 1 hour. The precipitates thus formed were filtered, washed with water and dried to give 5.2 parts of a red lake pigment powder.

REFERENCE EXAMPLE 2 (Preparation of a red lake pigment)

The lake pigment preparation was carried out in the same manner as described in Reference Example 1, except that 0.55 part of an indolenine dye of the formula:

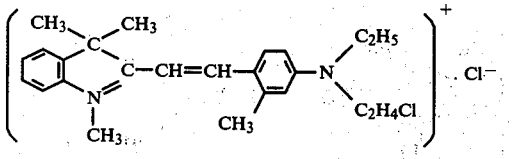

was used in place of the indolenine dye used therein. 5.1 parts of a red lake pigment powder which was colored a little bluer than that obtained in Reference Example 1 were thus obtained.

EXAMPLE 1

The materials used for the preparation of a dispersion were as follows:

| | |
|---|---|
| Red lake pigment obtained in Reference Example 1 | 20 parts |

-continued

| | |
|---|---|
| Resin-modified phenolformaldehyde resin | 50 parts |
| Linseed oil varnish | 30 parts |
| Isopar G | 320 parts |

These materials were milled together in a ball mill for 20 hours to prepare a concentrated dispersion of developer. 5 Parts by volume of the concentrate thus obtained were diluted with 500 parts by volume of Isopar G. and then 3 parts by volume of a 2% aluminum stearate solution were added thereto to make a developer. The developer was applied to development of the negatively charged electrostatic latent image on a zinc oxide sensitive paper. The red picture thus obtained was of a high color value, excellent tone reproduction and free from a flowing phenomenon (a tailing of the color from the picture during development and air-drying). Furthermore, the red shade of the picture was closer to the ideal magneta shade of three-color development than the red shade obtained when the two pigment components separately prepared were used. The developer was stable and caused no pigment settlement even after 10 days, and gave a print of the same high color value as with the freshly prepared developer.

EXAMPLE 2

The materials used for the preparation of a dispersion were as follows:

| | |
|---|---|
| Red lake pigment obtained in Reference Example 2 | 20 parts |
| Oil-modified alkyd resin | 80 parts |
| Isopar G | 320 parts |

These materials were milled together in a ball mill for 20 hours to prepare a liquid concentrate of developer. 5 Parts by volume of the concentrate thus obtained were diluted with 500 parts by volume of Isopar G, and then 3 parts by volume of a 2% zirconium naphthenate solution were added thereto to make a developer. The developer was applied to development of the negatively charged electrostatic latent image on a zinc oxide sensitive paper. The red picture thus obtained was of a high color value, and free from fogging and flowing. Furthermore, though the developer was used repeatedly for development, it gave positive images and high color values constantly. And the red shade of the picture was closer to the ideal magenta shade than that obtained when the two pigment components separately prepared were used.

EXAMPLE 3 (Example of a three-color printing)

The superiority of the present developer was confirmed by a positive-to-positive reproduction as follows:

A zinc oxide sensitive paper having photosensitivity throughout a range of visible spectrum was negatively charged, exposed through a combination of a colored positive film and a blue filter, the filter being closer to the paper, developed with a yellow developer, and then dried. The developed paper was treated two more times in the same manner as described above, except that the first operation used a green filter and the magenta developer prepared in Example 1 in place of the blue filter and the yellow developer, respectively, and that the second operation used a red filter and a cyan developer containing phthalocyanine blue. The colored positive picture thus obtained gave a well-reproduced picture of the original pattern.

The comparative data between the developers of the present invention and the well-known art are specifically shown in the following Table:

| Sample | Flowing of image from a solid area | Maximum color depth of image | Edge effect |
|---|---|---|---|
| Well-known P.T.M. acid lake of rhodazine (C.I. Pigment Red 81) | remarkably observed | 1.2 | observed |
| Developer of the Invention (Reference Example 1) | not observed | 1.8 | not observed |
| Developer of the Invention (Reference Example 2) | hardly observed | 1.9 | not observed |

As can be seen from the Table, the developers of the present invention are remarkably improved in that they are almost free from the flowing of the image which has been a most troublesome problem to solve and which has particularly caused much troouble in color development procedures.

What is claimed is:

1. An electrophotographic liquid developer holding positive charges in a stable state, which consists essentially of (1) a carrier which is a high electrical resistivity liquid having above $10^{10}\Omega$cm of volume resistivity, (2) a resinous, waxy or varnish compound selected from the group consisting of oil-modified alkyd resins, rosin-modified phenol-formaldehyde resins, polyhydric alcohol esters of hydrogenated rosin, polyacryl ester resins, polymethacryl ester resins, polyvinyl acetate and polystyrene, and (3) as a color component, a phosphotungstomolybdic acid lake of a mixture of an indolenine dye selected from the group consisting of:

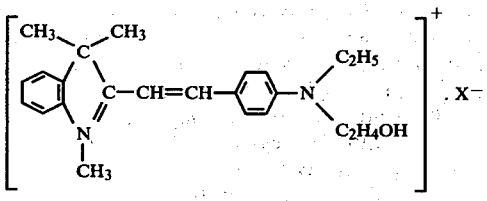

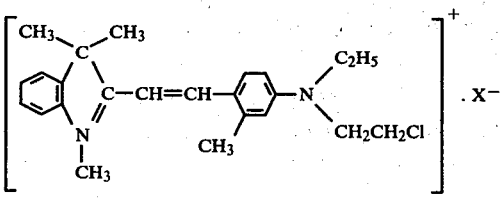

and

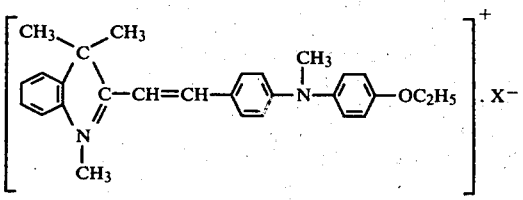

wherein $X^-$ is a colorless anion, with a xanthene dye of the formula:

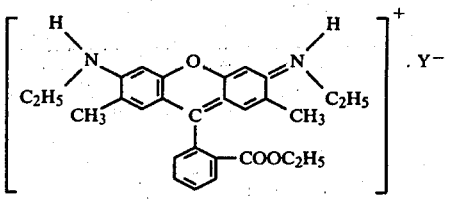

or

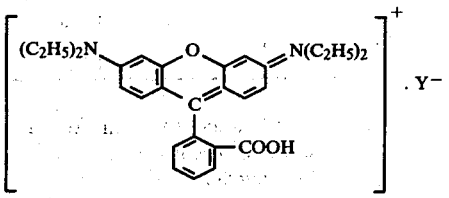

wherein $Y^-$ is a colorless anion,

2. The electrophotographic developer according to claim 1, wherein the indolenine dye has the formula:

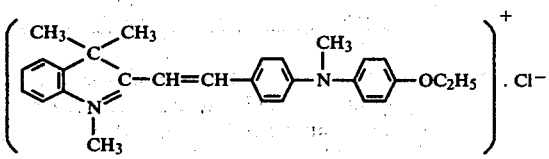

3. The electrophotographic developer according to claim 1, wherein the xanthene dye has the formula:

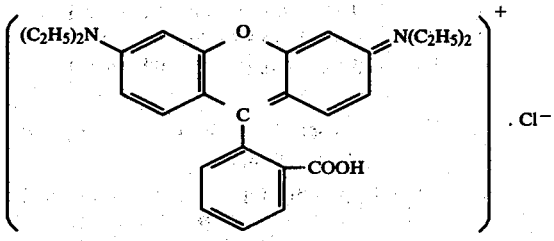

4. The electrophotographic developer according to claim 2, wherein the indolenine dye has the formula:

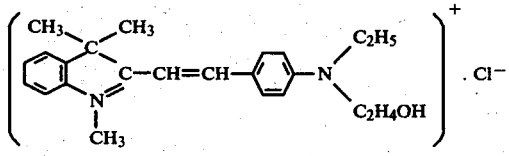

5. The electrophotographic developer according to claim 2, wherein the indolenine dye has the formula:

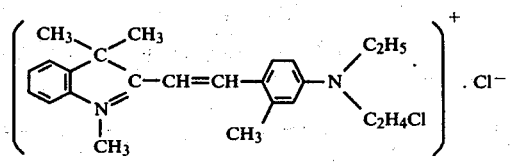

6. The electrophotographic developer according to claim 2, wherein the xanthene dye has the formula:
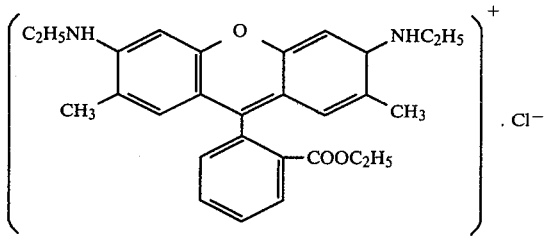
* * * * *